United States Patent [19]

Kaucic et al.

[11] Patent Number: 4,669,411

[45] Date of Patent: Jun. 2, 1987

[54] VESSEL MOORING SYSTEM AND METHOD

[75] Inventors: Robert A. Kaucic, Newark, Del.; Richard C. Walling, Gladwyne, Pa.

[73] Assignee: Express Marine, Inc., Camden, N.J.

[21] Appl. No.: 757,022

[22] Filed: Jul. 19, 1985

[51] Int. Cl.[4] ..... B63B 21/00

[52] U.S. Cl. ..... 114/230; 414/139; 414/145

[58] Field of Search ..... 414/139, 137, 140, 143, 414/144, 145; 114/230, 231, 293, 27; 440/33, 34, 35

[56] References Cited

U.S. PATENT DOCUMENTS

| | | | |
|---|---|---|---|
| 131,839 | 10/1872 | Baker | 440/35 |
| 3,104,766 | 9/1963 | Sasadi | 414/139 |
| 3,819,065 | 6/1974 | Tomizawa et al. | 414/139 |
| 3,891,079 | 6/1975 | Roper | 414/139 |

*Primary Examiner*—Sherman D. Basinger
*Attorney, Agent, or Firm*—Austin R. Miller

[57] ABSTRACT

An apparatus is provided for securing a vessel to a stationary mooring, which apparatus permits shifting movement of the vessel in a fore and aft direction relative to the mooring while restricting movement away from the mooring. The combination comprises docking lines extending fore and aft from the vessel to the mooring to cause shifting movement of the vessel in a fore and aft direction, an elongated rail affixed to the vessel and extending substantially parallel to its longitudinal axis, a breasting dolly embracing the rail and shiftable freely fore and aft on the rail, and a breasting line secured to the dolly and extending laterally of the fore and aft direction and fixed to the mooring in a manner to restrict the dolly and rail against movement away from the mooring.

10 Claims, 4 Drawing Figures

VESSEL MOORING SYSTEM AND METHOD

BACKGROUND OF THE INVENTION

This invention relates to an apparatus and method for securing a vessel to a stationary mooring. The invention is more particularly directed to an apparatus permitting shifting movement of the vessel in a fore and aft direction relative to the mooring while restricting movement of the vessel athwartship relative to the mooring.

DISCUSSION OF THE PRIOR ART

It is disclosed in U.S. Pat. No. 4,137,861 granted Feb. 6, 1979 to provide one or more breast lines to maintain a vessel against its dock or against the caissons utilized in mooring. Such breast lines, extending substantially perpendicular to the longitudinal axis of the vessel, and maintained relatively taut in order to keep the vessel against its mooring, provide little or no fore and aft leeway. This seriously interferes with loading and unloading operations, especially operations utilizing cargo space in the hold of the ship, since it is often necessary to move the vessel fore and aft in order to adjust it to the requirements of the loading or unloading mechanism.

As an example, coal barges are often provided with loading and unloading hatches, spaced along the length of the barge. If the barge is moored underneath a tower utilizing a continuously operating bucket conveyor, the available movement of the continuous conveyor is usually not sufficient to encompass the entire length of the barge. In such an event it is necessary to move the barge forward or aft in order to present the desired portion of the cargo hold to the effective operation of the continuous conveyor.

Further, sidewise movement of a loading or unloading device, particularly a continuous unloading conveyor, exerts sidewise forces upon the vessel itself, tending to move the vessel sidewardly toward and away from its mooring in an undesirable and sometimes uncontrollable manner. This condition sometimes leads to damage to the conveyor or even to the walls of the vessel.

OBJECTS OF THIS INVENTION

It is accordingly an object of this invention to provide an apparatus and method for securing a vessel to a stationary mooring, which apparatus permits shifting movement of the vessel in a fore and aft direction relative to the mooring while restricting movement of said vessel athwartship relative to the mooring.

Still another object is to provide an apparatus which automatically positions a cargo containing barge beneath a loading or unloading mechanism, with precise control of the side to side position of the vessel with respect to the mechanism, and which resists side movement when sidewise forces are exerted upon the cargo contained in the hold of the barge.

Other objects and advantages of this invention include the provision of such a device which is simple and effective to operate and maintain, which is free of interference with equipment and mechanisms utilized in the loading and unloading operations, and which requires little care or adjustment when in use. Other objects and advantages of this invention will further become apparent hereinafter, and in the drawings, in which.

DETAILED DESCRIPTION OF THIS INVENTION

Figure 1:
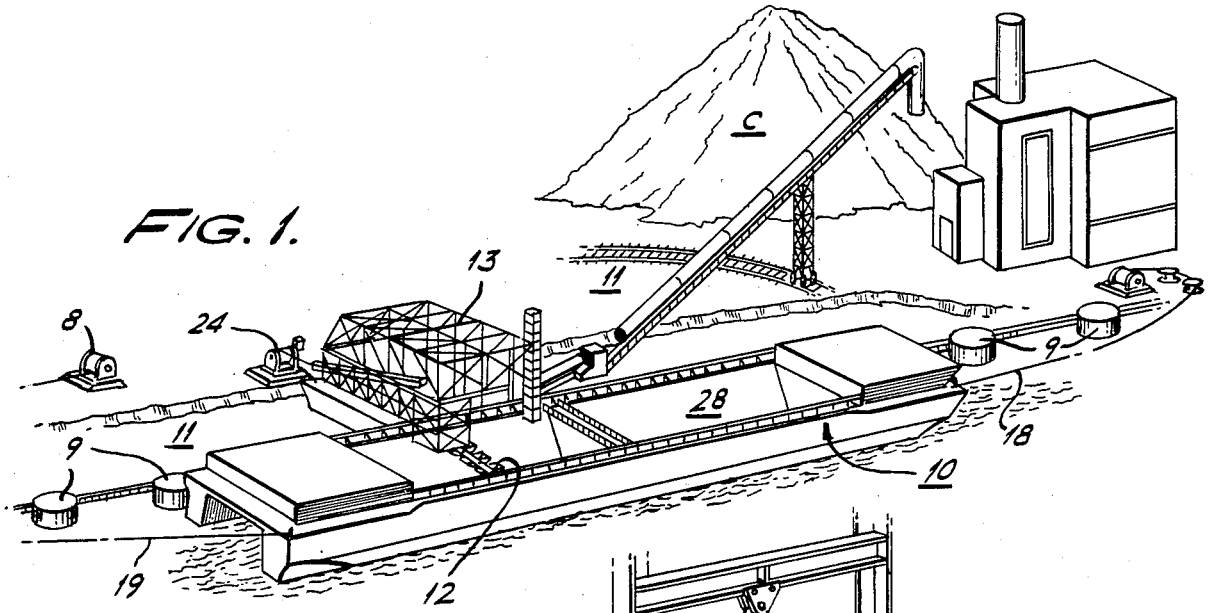
FIG. 1 is an aerial perspective view showing a barge tied to an unloading platform, and equipped with apparatus comprising one embodiment in accordance with this invention.

Turning now to FIG. 1, a barge 10 is shown tied to an unloading platform 11 and moored against caissons 9. A conveyor-digger 12, contained in a tower 13 extending over the top of the barge 10, is arranged for digging coal out of the barge and discharging to a conveyor belt which runs to a coal storage pile C. Sidewise action of the digger 12 tends to move the barge 10 sidewise toward and away from the unloading platform 11. Accordingly it is necessary or desirable to provide a breast line running from the inboard side of the barge 10 to a fixed point on the land, to keep the barge from being pushed outwardly away from unloading platform 11 by action of the digger 12. This invention relates to a structure and method for handling the breast line.

During the coal digging operation it is often necessary to move the barge 10 fore and aft with respect to the digger 12, using bow line 18 and stern line 19, shown in FIG. 1 with the use of dash lines and connected to winches 7, 8 fixed on the shore. Even while moving fore and aft it is necessary to have a breast line or the equivalent keeping the barge at all times against its caissons 9, or against the dock or other stationary mooring.

Figure 2:
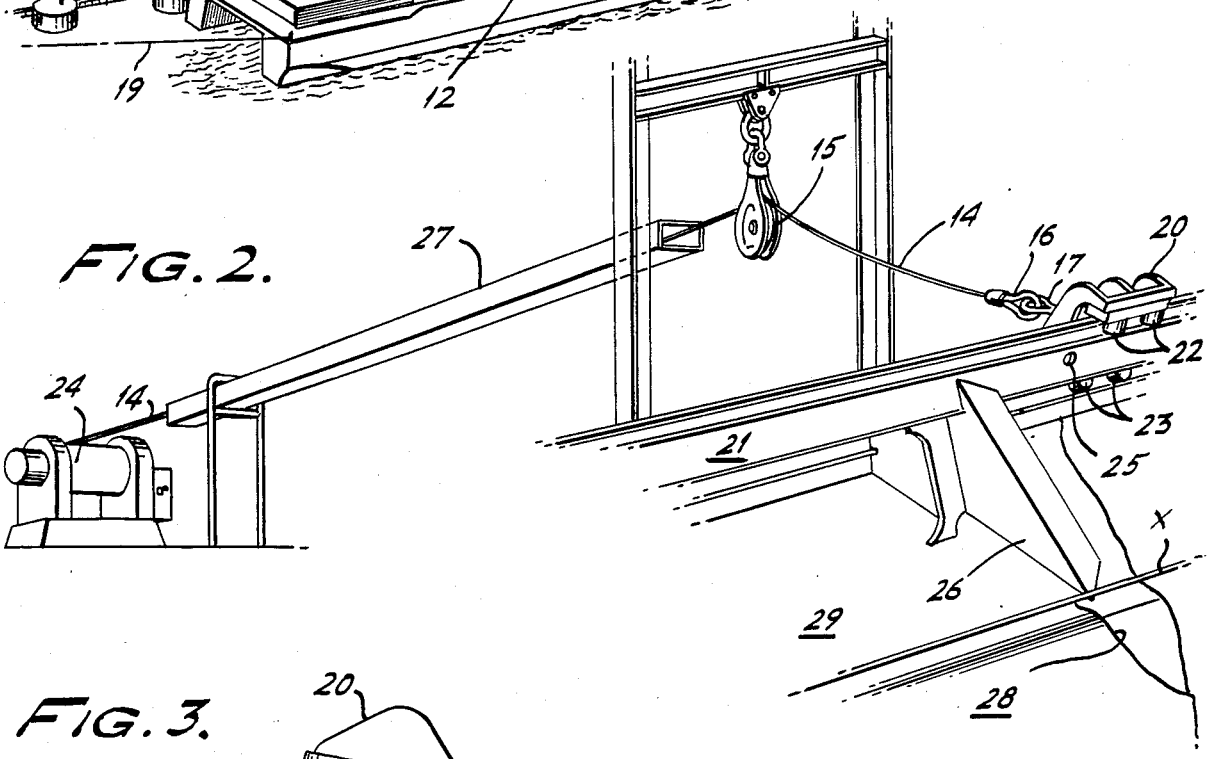
FIG. 2 is a fragmentary view in perspective, on the deck of a barge, showing important components and features in accordance with one embodiment of this invention.

Turning to FIG. 2, which is a view taken onboard the barge, the breast line 14 extends through a pulley 15 at the right hand portion of the drawing through a protective chute 27 to a winch 24. The breast line 14 is attached to an eye 16 connected to a second eye 17 fixed to a breasting dolly 20 which, in the embodiment shown, is substantially clamp shaped and embraces an elongated rail 21 to which it is affixed. The breasting dolly 20 has spaced apart sets of rollers 22, 23 embracing the rail 21, and is free to roll along the rail 21 to which it is affixed. Thus, a winch 24 (FIGS. 1 and 2) on the shore, or any stationary mooring, can be used to tighten up the breast line 14 and can pull on the breasting dolly 20, thereby pulling on the rail 21 itself, thus pulling the entire barge 10 toward the stationary mooring. This keeps the barge 10 against its caissons 9 or against a dock or similar stationary mooring to which it is intended to be maintained.

Further, even while maintaining the breast line 14 taut, the barge 10 can be moved fore and aft by manipulating its bow and stern lines 18, 19, but even during such movement the barge 10 is held close against its caissons 9, even notwithstanding a strong cross wind or the action of the digger 12 or cross currents or the like. This is an important feature and advantage of this invention, since the barge 10 can be moved forward and aft for optimum coal digging capability, while maintaining the barge 10 against its caissons 9, 9 at all times.

Figure 3:
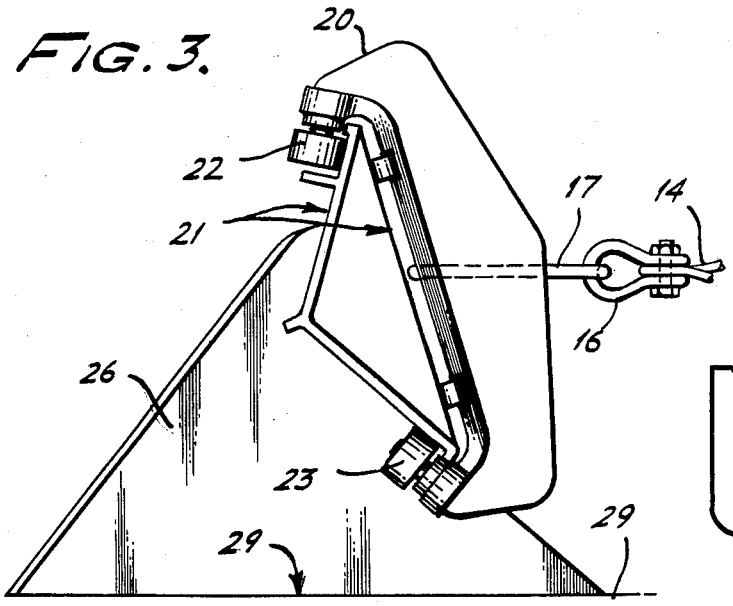
FIG. 3 is an enlarged view illustrating a novel form of breasting dolly and elongated rail which constitute important components in accordance with this invention.

Referring to FIGS. 2 and 3, it will be apparent that the elongated rail 21 is substantially triangular in cross section (as shown) and that the breasting dolly 20 is clamp-shaped, with spaced sets of rollers 22, 23 operative and effective upon spaced surfaces of the rail 21 and captured in such a manner that even a strong pulling force by the breast line 14 upon the breasting dolly 20 cannot remove the dolly 20 from the rail 14. Thus any tension force applied by the breast line 14 to the breasting dolly 20 is also applied to the rail 21, and, accordingly, to the barge 10 itself. Even when substantial tension is applied to and by the breast line 14, the rollers 22, 23 permit the elongated rail 21 to move fore and aft with respect to the breasting dolly 20, allowing free fore and aft adjustment of the position of the barge 10 with respect to the stationary mooring and with respect to the loading and unloading apparatus being used.

It will be appreciated that the rail 21 is maintained in a horizontal plane; even when the deck level of the barge changes from one level to another the rail 21 remains in the same horizontal plane. Although only one rail 21 is shown in the drawings, located at the port side of the barge 10, rails 21 may of course be provided along both the port and starboard sides of the barge 10 if desired.

Preferably a pin 25 is provided with the rail 21 to secure the breasting dolly 20 when not in use.

The cross section of the rail 21 and the particular shape of the breasting dolly 20 are not critical. Further, heavy deck support plates 26 (FIG. 3) are preferably secured to deck 29 and to support the rail 14, in order to resist side-to-side forces.

Preferably the breast line 14 is conducted upwardly from the breasting dolly 20 and over a pulley 15 and then down to a stationary point such as winch 24 on the dock or the land, as shown in FIG. 2. This permits many feet of upward and downward movement of the barge as it condition changes from fully loaded to empty.

Figure 4:
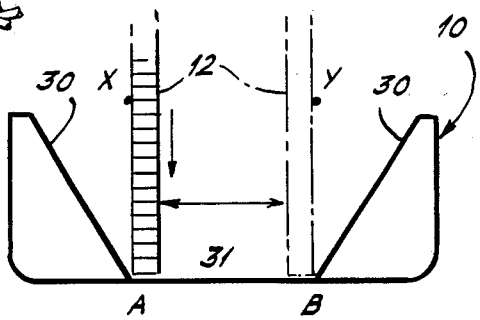
FIG. 4 is a diagraminatic showing of a typical coal barge, shown in unloading relationship with a continuous bucket conveyor.

As shown in FIG. 4, the barge is provided with a pair of inclined walls 30,30, preferably covered with a slippery polymeric material 28, arranged at an inclined angle to cause solid material such as coal to slide downwardly into the central bottom area 31. In such a configuration, the digger 12 may be provided as a continuous bucket type, and it can be manipulated from side to side between points A and B. The tower 13, located above the barge 10, has an operator who can move the bucket conveyor 12 from side to side and, to a limited degree, fore and aft. However, major fore and aft movement must be accomplished by moving the barge 10, by utilizing the conventional bow and stern lines 18, 19 and winches or the like, as heretofore described.

It is important to be able to move the digger 12 in a manner to dig along a straight line fore and aft. This is because the side walls 30, 30 of the barge 10 are sloped and covered with plastic to cause the coal to slide to the bottom.

The digger 12 can traverse only to limit positions A and B: to go further would result in damaging the inclined walls 30, 30 and their plastic coverings. Guide lines X and Y are extended fore and aft above the deck 29 as guides to display these limits to the bucket digger operator.

The breast line 14, combined with the caissons 9, keeps the barge in a fixed postion sidewise relative to the loading station, allowing the operator to traverse all the way to points A and B. Movement of the digger 12 sidewise against the coal cannot cause sidewise movement of the barge 10; otherwise there would be a danger that the inclined walls 30, 30 or their coatings would be damaged by the buckets or the conveyor.

It is important that the elongated rail 21 associated with the breast line 14 is securely mounted on the vessel 10 itself. Mounting such a rail on the dock or shore, coupled with a winch on the vessel, is a cumbersome and expensive construction; it has been found in such a case that the rail needs to be at least about twice as long as in this invention. Further, intervening objects interfere with loading, unloading and manipulative operations when the rail is positioned on the shore.

When reference is made in the specification and claims to a "stationary mooring" it is of course intended to include any object with respect to which the vessel is intended to be secured, including a dock, the shore or one or more caissons, or any combination of these, for example. One or more docking lines or the floating breast line of this invention, or any combination of these, may be connected to any object which is fixed with respect to the vessel; for example the breast line may be affixed to an anchoring point on the shore, or even to a structure located on a cargo loading and unloading apparatus located on the shore, all within the meaning of the term "stationary mooring" as used herein.

The term "elongated rail" is not intended to be limited to any specific cross-sectional shape but applies to any elongated anchoring means strong enough to restrict sidewise movement of the vessel and shaped to provide for free longitudinal movement of the breasting dolly 20. The rail shape shown in the drawings is not intended to be limiting, but is a preferred form since it resists damage when subjected to severe blows or shocks. Similarly, no specific size or shape limitations are implied in the use of the expression "breasting dolly" or "breast line". Indeed, in some installations other breasting means may be utilized, such as, for example, a cylinder affixed to the tower having an elongated piston rod fixed to the dolly.

Although only one such rail has been shown in the drawings more than one may be provided, one to port and the other to starboard, for example. Similarly two or more breast lines 14 may be provided on each rail, or otherwise, each with an associated breasting dolly. Other variations may be made, as will be apparent, including the substitution of equivalent elements for those shown in the drawings and the use of certain features independently of other features, all without departing from the spirit and scope of the invention.

The following is claimed:

1. In an apparatus for securing a vessel to a stationary mooring, which apparatus permits shifting movement of the vessel in a fore and aft direction relative to said mooring while restricting movement away from said mooring, the combination which comprises:

(a) docking lines extending fore and aft from the vessel to the mooring, (b) mechanical tensioning means connected to said docking lines controlling the docking lines to cause shifting movement of said vessel in a fore and aft direction, (c) an elongated rail affixed to said vessel and extending substantially parallel to its longitudinal axis, (d) a breasting dolly embracing said rail and shiftable freely fore and aft on said rail, and (e) breasting means secured to said dolly and extending laterally of said fore and aft direction and fixed to said mooring in a manner to restrict said dolly and rail against movement away from said mooring.

2. The apparatus defined in claim, 1, wherein docking line winches are located on said mooring and operatively connected to said docking lines.

3. The apparatus defined in claim 1, wherein said vessel is a barge and wherein said elongated rail extends less than the entire length of said barge.

4. The apparatus defined in claim 1, wherein said breasting dolly is clamp shaped and provided with spaced-apart cam rollers embracing said elongated rail and rollable freely with respect thereto.

5. The apparatus defined in claim 1, wherein said vessel has a cargo space with inclined walls and wherein an unloading device is positioned to extend into the space between said walls, and wherein said breasting means is a breast line which is trimmed to restrict sidewise movement of said inclined walls relative to said unloading device.

6. The apparatus defined in claim 1, wherein said rail has a substantially triangular cross section.

7. The apparatus defined in claim 1, wherein said breasting means is a breast line which is secured to and controlled by a mechanical tensioning means located in a fixed position.

8. The apparatus defined in claim 1, wherein said breasting dolly is provided with spaced apart cam rollers embracing said rail.

9. In a method for unloading cargo from a vessel, the steps which comprise:

(a) securing said vessel to a mooring through a breasting means connected to a breasting dolly which is held by a rail mounted on the vessel, said dolly being freely shiftable fore and aft along said rail and said vessel, (b) shifting said vessel fore and aft to different positions relative to said breasting dolly while maintaining said vessel against its mooring through the restraining action of said breasting means, and (c) removing cargo from said vessel in said different positions.

10. In an apparatus for securing a vessel to a stationary mooring, which apparatus permits shifting movement of the vessel in a fore and aft direction relative to said mooring while restricting movement away from said mooring, the combination which comprises:

(a) docking lines extending fore and aft from the vessel to the mooring, (b) mechanical tensioning means connected to said docking lines controlling the docking lines to cause shifting movement of said vessel in a fore and aft direction, (c) an elongated rail affixed to said vessel and extending substantially parallel to its longitudinal axis, (d) a breasting dolly engaged with said rail and shiftable freely fore and aft with respect to said rail, and (e) breasting means secured to said dolly and extending laterally of said fore and aft direction and fixed to said mooring in a manner to restrict said rail against movement away from said mooring, (f) wherein a pulley is provided on said mooring above the level of said elongated rail, and wherein said breasting means comprises a breast line which extends from said dolly upwardly through said pulley and downwardly to a fixed point on said mooring.

* * * * *